United States Patent [19]

Dangerously

[11] Patent Number: 4,736,478

[45] Date of Patent: Apr. 12, 1988

[54] WATERBED SHEET

[76] Inventor: Johnny L. Dangerously, 13058 W. 1st Dr., Lakewood, Colo. 80228

[21] Appl. No.: 70,930

[22] Filed: Jul. 8, 1987

Related U.S. Application Data

[63] Continuation-in-part of Ser. No. 850,711, Apr. 11, 1986, abandoned.

[51] Int. Cl.[4] ..... A47G 9/04

[52] U.S. Cl. ..... 5/485; 5/496; 5/497; 5/498

[58] Field of Search ..... 5/495–499, 5/485; 24/72.5

[56] References Cited

U.S. PATENT DOCUMENTS

| | | | |
|---|---|---|---|
| 3,996,633 | 12/1976 | Burke | 5/497 |
| 4,506,398 | 3/1985 | Hruban | 5/498 X |
| 4,520,518 | 6/1985 | Reaser | 5/498 |
| 4,539,723 | 9/1985 | Hillsberry | 24/72.5 X |
| 4,646,375 | 3/1987 | Parker | 5/485 |
| 4,686,726 | 8/1987 | Dunfee | 5/485 |

FOREIGN PATENT DOCUMENTS

| | | | |
|---|---|---|---|
| 2228156 | 12/1972 | Fed. Rep. of Germany | 24/72.5 |

*Primary Examiner*—Michael F. Trettel
*Attorney, Agent, or Firm*—Thomas & Kennedy

[57] ABSTRACT

The waterbed sheet assembly 25 includes a top sheet 28, and a bottom sheet 26, with the sheets sewn together along their bottom edges. A corner pocket structure 30 is formed on the corners of the bottom sheet, and each corner pocket structure includes a corner pocket panel 31 sewn along its right angle edges 32 and 33to the adjacent side and end edges of the sheet, with a sleeve 40 attached longitudinally along the diagonal free edge 34 of the corner pocket structure. A bar 42 is inserted into the sleeve 40, with the bar extending diagonally across and beneath the corner of the waterbed mattress. The weight of the water in the mattress holds the bar and pocket structure in place beneath each corner of the mattress.

8 Claims, 2 Drawing Sheets

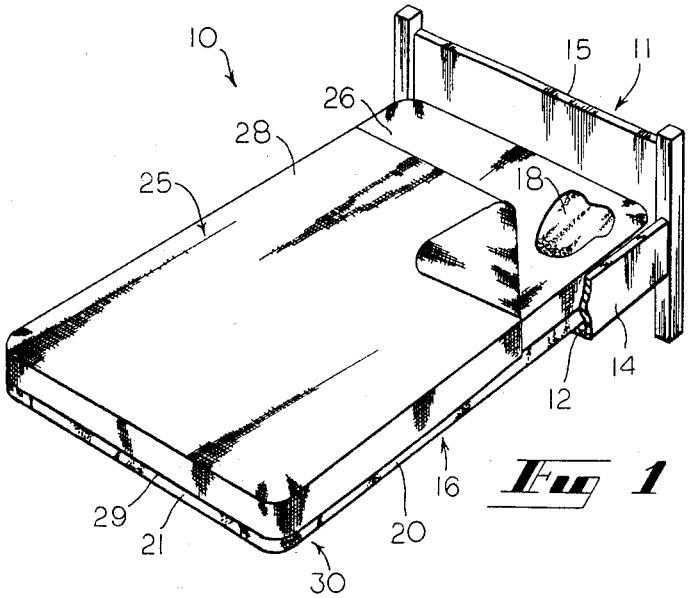
Fig 1
Fig 2
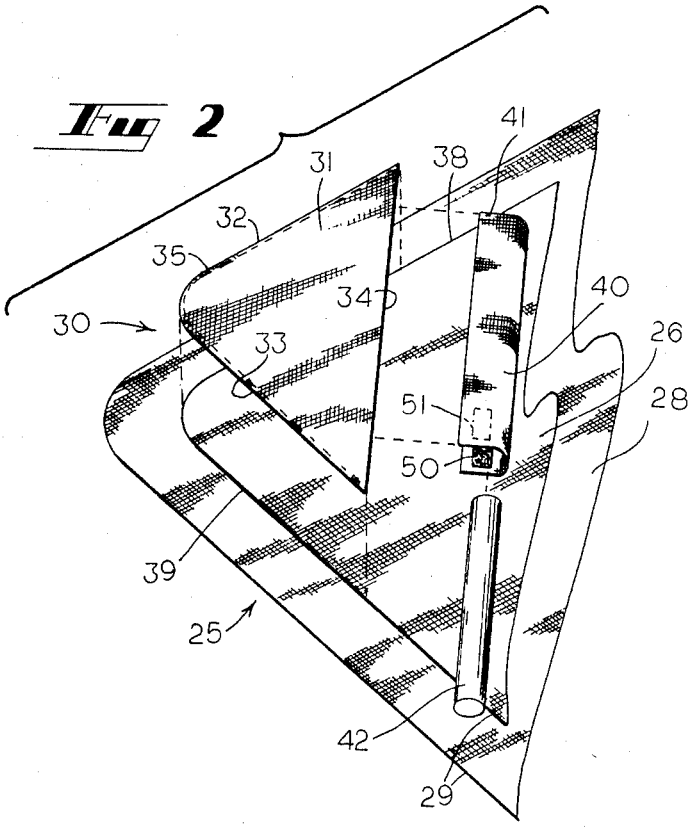

Fig 3
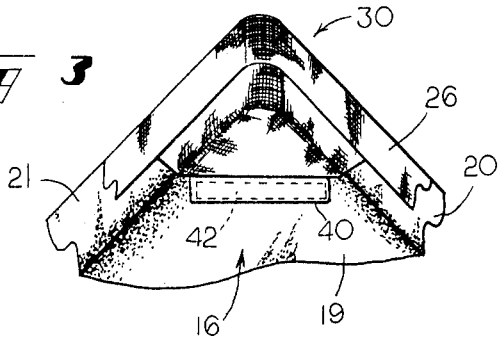
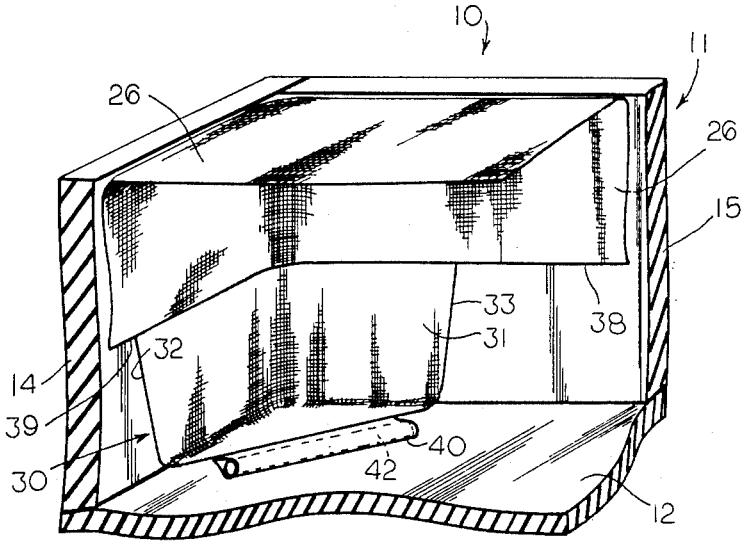
Fig 4
Fig 5
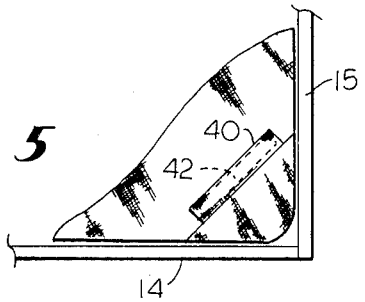

WATERBED SHEET

CROSS REFERENCE TO RELATED APPLICATION

This application is a continuation-in-part of my prior U.S. application Ser. No. 850,711 filed Apr. 11, 1986 now abandoned.

FIELD OF THE INVENTION

This invention relates generally to a sheet assembly for a waterbed, and more particularly to a sheet assembly that has form fitting or "contoured" corners formed on the bottom sheet that are to be mounted about the corners of a waterbed mattress for firmly holding the sheet in proper position on the mattress.

BACKGROUND OF THE INVENTION

Waterbed or liquid filled mattresses are very flexible, particularly at the edges and at the corners of the mattress, and it is somewhat difficult to cause a sheet to stay in place on the waterbed mattress. Typically, even a form fitting bottom sheet that fits about the side and end edges of the waterbed mattress can be dislodged in normal use of the waterbed. Further, the attachment of the top sheet at the foot of the waterbed is even more difficult, and many top and bottom sheets for waterbeds are made as a unitary structure by being connected together along their bottom edges. This allows the top sheet to be secured to the bed by the more securely attached bottom, form fitting sheet that extends about the corner structures of the waterbed mattress. However, when the top sheet is pulled during normal use of the bed, there is some likelihood that both the top and bottom sheets will be pulled off the foot of the mattress.

One of the prior art waterbed sheet arrangements is disclosed in U.S. Pat. No. 3,996,633, whereby corner pockets are formed in the bottom sheet so as to fit about and partially beneath the corners of the waterbed mattress. However, the corner structures of waterbed mattresses are so flexible that the form fitting sheets especially designed and precisely formed to tightly fit the corners of a waterbed mattress still can be inadvertantly dislodged during use of the bed.

SUMMARY OF THE INVENTION

Briefly described, the present invention comprises a waterbed sheet assembly that includes novel corner structures for the bottom sheet, whereby the bottom sheet is securely fastened about the corners of the waterbed mattress. The corner structure at each corner of the bottom sheet includes a corner pocket which is approximately triangular shaped, with two edges of the triangular pocket attached to the adjacent side and end edges of the bed sheet, and with the third edge of the triangular pocket being free and extending diagonally across the corner of the bed sheet. A sleeve having an open end is attached to the free edge of the corner pocket, and a rigid bar is inserted into the sleeve.

With this arrangement, the bed sheet is mounted on the waterbed mattress by placing the corners of the waterbed mattress into the pockets of the bed sheet, with the sleeve and its rigid bar positioned beneath the mattress and extending diagonally across the corner of the mattress. The weight of the water in the waterbed mattress tends to hold the bar, its sleeve and the corner pocket of the sheet in place, so that when the sheet is pulled during normal use of the waterbed, the corner structure of the sheet is firmly anchored in place and tends to resist the pulling of the sheet. Further, the diagonal orientation of the stiff bar in the sleeve of the pocket structure tends to cause the bar to become displaced from the corner of the mattress so that a substantial amount of the water in the corner of the mattress applies its weight between the bar and the corner of the mattress and therefore tends to firmly anchor the bar in a static position beneath the mattress. Further, the bar tends to become wedged between the side rail and end rail of the frame of the water bed. This tends to further secure the pocket of the bed sheet in position beneath the corner structure of the waterbed mattress.

Thus, it is an object of this invention to provide an improved waterbed sheet assembly which has corner structures that can be firmly mounted to the corners of the waterbed mattress.

Another object of this invention is to provide an inexpensive corner structure for sheets for waterbed mattresses, whereby the sheets are firmly held in proper position on the waterbed mattress during normal use of the waterbed mattress.

Another object of this invention is to provide a corner structure for the bed sheet to be used on a waterbed mattress, whereby the weight of the water in the mattress tends to firmly hold the corners of the sheet in place about the corners of the mattress.

Other objects, features and advantages of this invention will become apparent upon reading the following specification, when taken in conjunction with the accompanying drawings.

BRIEF DESCRIPTION OF THE DRAWINGS

FIG. 1 is a perspective illustration of a waterbed, which includes a waterbed mattress, a bottom sheet and a top sheet.

FIG. 2 is a perspective, exploded illustration of the bottom corner structure of the waterbed sheet of FIG. 1.

FIG. 3 is a perspective illustration of a corner of the waterbed mattress and a corner of the waterbed sheet, with the mattress tilted up to show the bottom surface of the mattress and the bottom of the corner structure of the sheet.

FIG. 4 is a perspective illustration of the corner structure of the waterbed sheet, showing how the sheet is fitted within the frame of the mattress, with the mattress being omitted from this view.

FIG. 5 is a bottom view of the corner of the frame of a waterbed with the bottom support surface of the frame removed, showing the corner structure of the waterbed sheet.

DETAILED DESCRIPTION

Referring now in more detail to the drawings, in which like numerals indicate like parts throughout the several views, FIG. 1 illustrates a waterbed 10 which includes a frame 11 that includes the lower horizontal support 12, side rails 14 and end supports 15. Only one side rail 14 and one end support 15 are shown in FIG. 1. A waterbed mattress 16 is supported in the frame 11. Mattress 16 includes horizontally extending top and bottom surfaces 18 and 19 (FIG. 3), opposed side edges 20, and opposed end edges 21. The side and end edges 20 and 21 meet each other to form a corner structure at the four corners of the mattress. The mattress is filled with water or other suitable liquid, as is conventional in the art, and the side and end edges of the mattress receive lateral support from the side rails 14 and end supports 15.

Waterbed sheet assembly 25 is mounted to the waterbed mattress 16. Waterbed sheet assembly 25 includes the bottom sheet 26 and the top sheet 28. Both sheets are approximately rectangular and the top sheet 28 is sewn at its foot to the foot of bottom sheet 26, along the line of connection 29. The bottom sheet is of a length and breath slightly greater than the corresponding length and breadth of the top surface 18 of the waterbed mattress, so that the edges of the waterbed sheet overlie the edges of the mattress and turn downwardly so as to lie along the side and end edges 20 and 21 of the mattress.

As illustrated in FIG. 2, a corner pocket structure 30 is formed at each corner of the bottom sheet 26. The corner pocket panel 31 is triangular and includes right angle edges 32 and 33 and free edge 34. The right angle edges 32 and 33 are sewn by stitching 35 to the side and end edges 38 and 39 of the bottom sheet 26. The connection of the right angle edges 32 and 33 to the edges of the bottom sheet forms a pocket at the corner of the bottom sheet. Another panel of sheet material is folded over so as to form a sleeve 40, and the sleeve 40 is sewn at its edges to the free edge 34 of the corner pocket panel 31. Also, one end 41 of the sleeve is sewn closed, which leaves the other end open. A rectilinear bar or tube 42 is inserted through the open end into the sleeve 40.

When the waterbed sheet 26 is to be mounted on a waterbed mattress 16, the person making up the bed typically will insert the bars 42 into the sleeves 40 at each corner of the bottom sheet 26, and then spread the sheet out over the mattress. The person usually lifts each corner of the waterbed mattress (FIG. 3) and grasps the sleeve 40 and bar 42 and pulls the corner pocket of the sheet about the corner of the mattress so as to expediently fit the corner pocket structure 30 at each corner of the bed sheet about a corner of the waterbed mattress. When the corner pocket structure has been mounted to the corner of the mattress, the person lowers the corner of the mattress back into the confines of the side rails and end supports 14 and 15 of the frame 11 of the waterbed.

As illustrated in FIGS. 4 and 5, when the mattress has been lowered back into the frame of the bed, the bar 42 in sleeve 40 at each corner of the mattress will extend diagonally across the corner of the mattress, beneath the mattress, and will be pressed by the weight of the mattress and the water within the mattress downwardly toward engagement with the lower horizontal support 12 of the frame 11. The upwardly protruding shape of the rigid bar 42 tends to cause the lower surface 19 of the waterbed mattress to conform to the shape of the bar 42, so that the mattress tends to become stabilized over the bar 42. The weight of the water tends to hold the bar in place, and makes it more difficult to pull the bottom sheet 26 off of the mattress.

The diagonal placement of the bar 42 at each corner of the mattress also causes the bar to tend to become wedged between the side rails 14 and end supports 15. This tends to even more securely hold the corner pocket structure 30 in proper position on the corner of the mattress.

Preferably, the length of each sleeve 40 is greater than the length of each bar 42, so that when a bar is inserted in a sleeve, the sleeve will completely cover the bar and will tend to protect the mattress from any abrasion with respect to the bar. Further, the open end of the sleeve 40 can be closed, if desired, by Velcro® strips 50 and 51 (FIG. 2) being attached to the facing portions of the sleeve 40, or by other conventional connection means such as a button and buttonhole, or a clamp. This tends to prevent the rigid bar 42 from falling out of its sleeve as the sheet is applied to the mattress.

As previously stated, the top sheet 28 is attached along its lower edge 29 to the lower edge of the bottom sheet 26. The top sheet is therefore securely mounted at its bottom to the waterbed mattress by virtue of the corner pocket structures and the insertion of the bar 42 in each sleeve 40 at the corner pocket structures.

It should be understood that the just described embodiment of the invention merely illustrates principles of the invention in a preferred form. Other modifications and variations may be made thereto without departure from the spirit and scope of the invention as set forth in the following claims.

I claim:

1. A bed sheet or the like for placement on a rectangular waterbed mattress with the mattress including a top surface, a bottom surface and opposed side surfaces and opposed end surfaces with corners formed by the intersections of the side surfaces with the end surfaces, said bed sheet comprising a substantially rectangular panel member of a length and width greater than the length and width respectively of the mattress for placement in overlying relationship on the top surface of the mattress with the side edges and end edges of said panel member extending along the side surfaces and end surfaces of the mattress and with corners formed at the intersections of the side edges with the end edges of said panel member for overlying the corners of the mattress, a corner pocket member at each corner of said panel member with each said corner pocket member including a first edge portion connected to a side edge of said panel member and a second edge portion connected to an end edge of said panel member and a free edge portion extending diagonally between said first and second edge portions to form with a corner of said panel member a corner pocket for receiving a corner of the mattress, said corner pocket members each including an elongated open ended sleeve extending longitudinally along the free edge portion of the pocket member diagonally across a corner of the panel member and constructed and arranged to receive a rectilinear bar member, whereby when the bed sheet is placed about a water bed mattress with the corners of the mattress positioned in the pockets of the bed sheet and a bar member is positioned under the mattress in each sleeve the bar members extend diagonally beneath the corners of the mattress and function to firmly anchor the corners of the panel member to the corners of the mattress.

2. The bed sheet of claim 1 and wherein said sleeve of each corner pocket member is closed at one end.

3. The bed sheet of claim 1 and further including a rectilinear bar member positioned in each of the sleeves of said bed sheet.

4. The bed sheet of claim 3 and wherein said rectilinear bar member comprises a tube of a length less than the length of its sleeve whereby the tube is surrounded by the sleeve and does not make contact with the mattress.

5. The bed sheet of claim 3 and further including a rectangular top sheet including opposed side edges and opposed end edges and attached along one of its end edges to an end edge of said panel member.

6. A bed sheet or the like for placement on a rectangular waterbed mattress with the mattress including a top surface, a bottom surface and opposed side surfaces and opposed end surfaces with corners formed by the intersections of the side surfaces with the end surfaces, said bed sheet comprising a substantially rectangular panel member for placement in overlying relationship on the top surface of the mattress with the side edges and end edges of the panel extending along the side surfaces and end surfaces of the mattress and with corners formed at the intersections of the side edges with the end edges for placement at the corners of the mattress, a corner pocket member at each corner of said panel with each corner pocket member including a first edge portion connected to a side edge of the panel and a second edge portion connected to an end edge of the panel and a free edge portion extending between said first and second edge portions to form with the panel a pocket for receiving a corner of the mattress, a bar means connected to the free edge portion of the pocket member whereby when the bed sheet is placed about a waterbed mattress with the corners of the mattress positioned in the pockets of the bed sheet and a bar member is positioned beneath the mattress at each corner of the mattress the weight of the water in the mattress holds the bar member and the pocket member in a static position to firmly anchor the corners of the sheet to the corners of the mattress.

7. A bed sheet or the like for placement on a rectangular waterbed mattress with the mattress including a top surface, a bottom surface and opposed side surfaces and opposed end surfaces with corners formed by the intersections of the side surfaces with the end surfaces, said bed sheet comprising a substantially rectanular panel member of a length and width corresponding to length and width respectively of the mattress for placement in overlying relationship on the top surface of the mattress with the side edges and end edges of said panel member extending along the side surfaces and end surfaces of the mattess and with corners formed at the intersections of said side edges with said end edges of said panel member for overlying the corners of the mattress, a corner pocket member at each corner of said panel member with each said corner pocket member including a first edge portion connected to a side edge of said panel member and a second edge portion connected to an end edge of said panel member and a free edge portion extending between said first and second edge portions to form with a corner of said panel member a corner pocket for receiving a corner of the mattress, said corner pocket members each including an elongated open ended sleeve extending longitudinally along the free edge portion of the pocket member extending diagonally across a the corner of the panel member and constructed and arranged to receive a rectilinear bar member, and means for closing said sleeve at its opposite ends, whereby when the bed sheet is placed about a waterbed mattress with the corners of the mattress positioned in the pockets of the bed sheet and a bar member is positioned under the mattress in each sleeve the bar members extend diagonally beneath the corners of the mattress and function to firmly anchor the corners of the panel member to the corners of the mattress.

8. A bed sheet or the like for placement on a rectangular waterbed mattress with the mattress including a top surface, a bottom surface and opposed side surfaces and opposed end surfaces with corners formed by the intersections of the side surfaces with the end surfaces, said bed sheet comprising a substantially rectangular panel member of a length and width corresponding to the length and width respectively of the mattress for placement in overlying relation ship on the top surface of the mattress with the side edges and end edges of said panel member extending along the side surface and end surfaces of the mattress and with corners formed at the intersections of the side edges with the end edges of said panel member for overlying the corners of the mattress, a corner pocket member at each corner of said panel member with each said corner pocket member including a first edge portion connected to a side edge of said panel member and a second edge portion connected to an end edge of said panel member and a free edge portion extending between the edge portions to form a pocket for receiving a corner of the mattress, said corner pocket members each including means for supporting an elongated bar member or the like said means attached to the free edge portion and extending diagonally across the corners of said panel member, whereby when the bed sheet is placed about a waterbed mattress with the corners of the mattress positioned in the pockets of the bed sheet and a bar member is supported by the pocket member diagonally across the corners of the panel member under the mattress the bar members extend diagonally beneath the corners of the mattress and anchor the corners of the panel member to the corners of the mattress.

* * * * *